United States Patent [19]

Gerding et al.

[11] Patent Number: 4,589,465

[45] Date of Patent: May 20, 1986

[54] TOP POUR SHROUD

[75] Inventors: Charles C. Gerding, Pittsburgh; Harold L. Majors, Beaver Falls, both of Pa.

[73] Assignee: LTV Steel Company, Inc., Cleveland, Ohio

[21] Appl. No.: 560,899

[22] Filed: Dec. 14, 1983

[51] Int. Cl.[4] ..... B22D 23/00

[52] U.S. Cl. ..... 164/66.1; 164/133; 164/259; 164/337; 222/600

[58] Field of Search ..... 164/66.1, 133, 259, 164/335, 337, 415, 437–439, 475, 488; 222/600, 603

[56] References Cited

U.S. PATENT DOCUMENTS

| | | | |
|---|---|---|---|
| 3,174,199 | 3/1965 | Trindler | 164/66.1 |
| 3,616,843 | 11/1971 | Newhall et al. | 164/259 |
| 3,918,613 | 11/1975 | Shapiand, Jr. | 222/603 |
| 3,946,907 | 3/1976 | Berve | 164/61 |
| 4,131,219 | 12/1978 | Hind et al. | 164/475 |
| 4,211,390 | 7/1980 | Poole et al. | 164/259 |
| 4,222,505 | 9/1980 | Daussan et al. | 164/437 |

FOREIGN PATENT DOCUMENTS

| | | | |
|---|---|---|---|
| 2453631 | 5/1975 | Fed. Rep. of Germany | 164/415 |

*Primary Examiner*—Nicholas P. Godici
*Assistant Examiner*—Richard K. Seidel
*Attorney, Agent, or Firm*—David C. Hanson; Robert P. Wright; Thaddeus A. Zalenski

[57] ABSTRACT

An apparatus and method for providing a protective gas shroud around molten metal being teemed from a ladle having a slide gate secured to the bottom. The apparatus comprises a plenum box sealed to and extending downwardly from the sliding part of the slide gate. A hood is arranged to telescope over the plenum box and form a rough sliding seal therewith. The hood has a skirt flange at the bottom thereof. The width of said skirt flange in the direction of movement of the slide gate is greater than the maximum slide gate movement. Means are fixed relative to the plenum box to raise and lower the hood. Means are provided for introducing a protective gas into the plenum box. The method comprises aligning the ladle with the mold into which hot metal is to be teemed. The means for raising and lowering the hood is activated to lower the skirt flange to rest upon the top of the mold or hot top. Thereafter the slide gate is opened dragging the hood over the top of the mold or hot top into alignment with the mold.

18 Claims, 6 Drawing Figures

TOP POUR SHROUD

FIELD OF USE

This invention relates to teeming molten metal (for example, liquid steel) from a movable ladle having a slide gate nozzle into a plurality of ingot molds. More specifically, the invention relates to protecting the molten metal from the well-known, harmful effects of normal atmosphere absorption by surrounding the molten metal with an envelope of inert gas. Thus, in the case of molten steel, oxygen and nitrogen cannot be readily absorbed by the steel.

DESCRIPTION OF THE PRIOR ART

The advantage of protecting molten metal from the atmosphere during teeming is well understood. Numerous shrouding devices and methods have been proposed. A great number are directed to continuous casting apparatus wherein the ladle and the mold remain stationary at all times. Typical United States patents relating to such apparatus are the following: U.S. Pat. Nos. 3,102,591; 3,265,348; 3,402,757; 3,439,735; 3,451,594; 3,572,422; 3,756,305; 3,841,385; 3,908,734; 3,963,224; 4,084,799; 4,090,552; 4,102,386; 4,200,138; and 4,218,048.

Keel et al. U.S. Pat. No. 3,174,200 is pertinent for showing a process and apparatus for purging a mold with an inert gas. It teaches providing a vented cover for the mold which will melt away upon commencement of teeming and providing a narrow shroud casing (narrower than the opening in the mold) of a fixed length hung from the lower surface of the ladle. The ladle, due to the fixed length of the casing, must be raised and lowered to accommodate molds of varying height. The Keel et al. patent teaches an argon flow rate of between 16 and 20 cubic feet per minute.

Poole et al. U.S. Pat. No. 4,211,390 relates to an apparatus for protecting a stream of molten metal during teeming with an inert gas. The stream is surrounded by a collapsible shield comprised of two coaxial cylinders. Each cylinder is supported for vertical movement from bifurcated arms fixed relative to the ladle carriage which arms permit adjustment of the length of the shield thus providing a certain amount of accommodation for ingot molds for diverse heights. However, the shield is not adapted for use with slide gate nozzles nor to be turned about two axes to accommodate molds having an uneven top edge.

Hind et al. U.S. Pat. No. 4,131,219 relates to pouring molten metal from a ladle having a slide gate on the bottom thereof. Inert gas is forced through nozzles in the direction of the flowing metal stream for the purpose of forming an annular curtain of gas. The pressures upstream of the nozzles are in the vicinity of 10 to 20 psi and the flow rates are between 30 and 40 cubic feet per minute. No mechanical-shield is disclosed or even suggested by Hind et al.

It is an advantage according to this invention to provide a method and apparatus for teeming molten metal from a ladle having a slide gate. The molten metal stream is protected by inert gas at a static pressure just exceeding atmospheric pressure.

The apparatus according to this invention provides a gas shroud for the stream without any time penalty for lifting and lowering the ladle and accommodates the slide gate motion without ladle manipulation.

It is an advantage of this invention that teeming aluminum killed steel from a ladle having a slide gate into traditional ingot molds can be slowed without excessive nozzle clogging. This slow teeming has several benefits, including reduction of surface cracks in the ingot which cause semifinish rejects.

SUMMARY OF THE INVENTION

Briefly according to this invention, there is provided an apparatus for providing a protective gas shroud around molten metal being teemed from a ladle having a slide gate secured to the bottom thereof. The apparatus comprises a plenum box sealed to and extending downwardly from the sliding part of the slide gate. It further comprises a hood arranged to telescope over the plenum box forming a rough sliding seal therewith. The hood has a skirt flange at the bottom thereof. The width of the skirt flange in the direction of movement of the slide gate is preferably greater than the maximum slide gate movement. An actuating mechanism fixed relative to the plenum box raises and lowers the hood. Conduits are provided for introducing a protective gas into the plenum box. Thus the ladle may be aligned with the mold into which hot metal is to be teemed. The actuating mechanism then lowers the hood so that the skirt flange rests upon the top of the mold or hot top. Thereafter the slide gate may be opened dragging the hood over the top of the mold into alignment therewith.

More specifically, this invention is related to an apparatus secured to the bottom of a slide gate assembly typically comprising a fixed apertured plate, a movable apertured plate with an elongate nozzle extending downwardly therefrom. A main housing secured to the bottom of the ladle provides a slideway for a spring box carriage secured within the slideway. The spring box carriage carries and biases the movable apertured plate against the stationary apertured plate. A hydraulic piston or the like moves the spring box carriage within the main housing to bring the apertures into and out of registery. A plenum box extends downwardly from and is secured to the underside of the spring box carriage and is carried thereby. The plenum box has an opening in the top thereof to receive the downwardly extending elongate nozzle and means to form a rough seal around the periphery of the nozzle where it extends through the top of the plenum box. A bracket is fixed to the plenum box and extends thereaway for supporting the actuating mechanism comprising a shaft pivotally secured in the said bracket with a crank arm and lifting forks fixed to the shaft. (Alternatively, the shaft may be secured to the bracket by two rotating arms, which arms are pivotally secured to the bracket. In this case, the actuating mechanism is secured directly to the shaft without the need of a crank arm.) A hood is arranged to be telescoped over the plenum box having trunnions extending therefrom for engaging the distal ends of the lifting forks. The hood also has a flanged skirt extending downwardly from the lower edge thereof. A pneumatic or hydraulic piston or the like extending from the bracket causes rotation of the shaft thus causing the distal ends of the lifting forks to travel through an arcuate path raising and lowering the hood.

According to a preferred embodiment, the hood is provided with a separate top plate or ring with an aperture therein. The top plate slidably engages the top surface of the hood and slides horizontally relative to the remainder of the hood. Thus raising and lowering of the hood through its arcuate path by rotation of the shaft does not cause binding of the hood on the plenum box, while minimizing the clearance annulus through which gas may escape.

THE DRAWINGS

Further features and other objects and advantages of this invention will become clear from the following detailed description made with reference to the drawings in which FIG. 1 is an overall view of a ladle with a slide gate and an ingot mold with the shroud apparatus according to this invention shown therebetween in partial section;

DESCRIPTION OF THE PREFERRED EMBODIMENT

Figure 1:
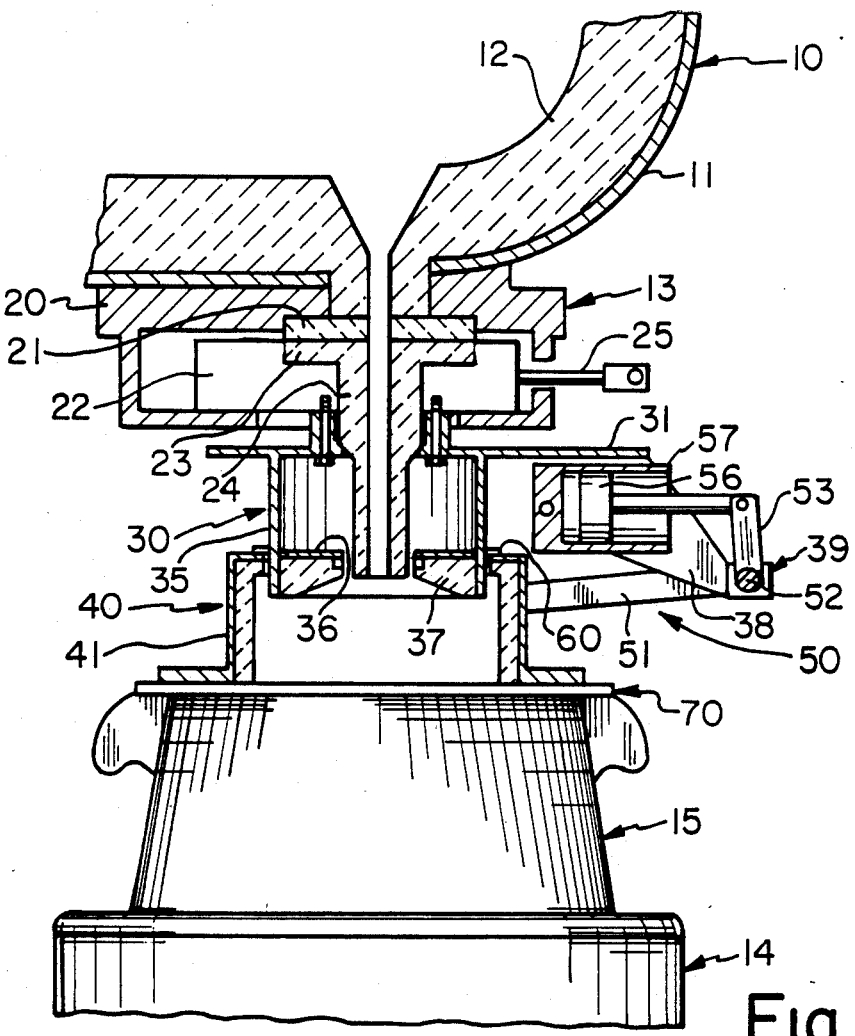

Referring to FIG. 1, there is shown a portion of a ladle 10 having a steel shell 11 and a refractory lining 12. An opening in the base of the ladle passes through both shell and lining. Mounted to the shell 11 adjacent the opening is a slide gate 13 of typical construction. (The minor details of the ladle and the slide gate form no part of this invention.) Positioned below the slide gate 13 (shown in the open position) is an ingot mold 14 having a permanent hot top 15 positioned thereon. The use of hot tops is not essential in the practice of this invention. Thus, throughout the specification and claims herein the surface onto which the top pour shroud according to this invention is brought to rest is referred to as the "top of the mold or hot top". The slide gate 13 has a fixed apertured plate 21 firmly secured below the opening in the bottom of the ladle by slide gate housing 20. The slide gate housing 20 defines a slideway in which spring box carriage 22 is slidably positioned. The spring box carriage holds the moving apertured plate 23 with an elongate nozzle extension 24 pendant therefrom with the nozzle bore aligned with the aperture in the moving apertured plate. It is a feature according to this invention that the nozzle extension is made sufficiently long to cooperate with the plenum box and hood (to be described). By moving the aperture of the plate 23 into registry with the aperture in the plate 21, the gate is placed in its open or dispensing position as shown in FIG. 1. By moving the apertures out of registry, the gate is closed. The elongate nozzle extension 24 by itself is not new. However, the use of an elongate nozzle extension in conjunction with slow (throttled) pouring has substantial benefits. The throttled (partly open gate) results in a non-full nozzle extension below it and insures absence of a suction condition at the sliding surfaces of the gate. The elongate nozzle extension appears to collimate the flow of molten metal avoiding an otherwise rather splashy flow.

The spring box carriage is provided with means for biasing the moving apertured plate 23 tightly up against the fixed plate 21 to prevent leakage of hot metal between the plates but to permit the relative sliding movement required for opening and closing the gate. The springs (not shown) effecting the bias are positioned within the spring box carriage 22. Thus, the spring box carriage itself slides directly against the slideway in the slide gate housing 20. Typically the length of travel of the moving plate is six inches. A rod 25 engates a piston from an extensible hydraulic device (not shown) for moving the spring box carriage through its travel.

The specific improvement in an apparatus according to this invention is fixed to the bottom of the spring box carriage 22 and is carried back and forth by it. The shroud assembly comprises a plenum box assembly 30, a hood assembly 40 and actuating mechanism 50 for moving the hood relative to the plenum box.

Figure 2:
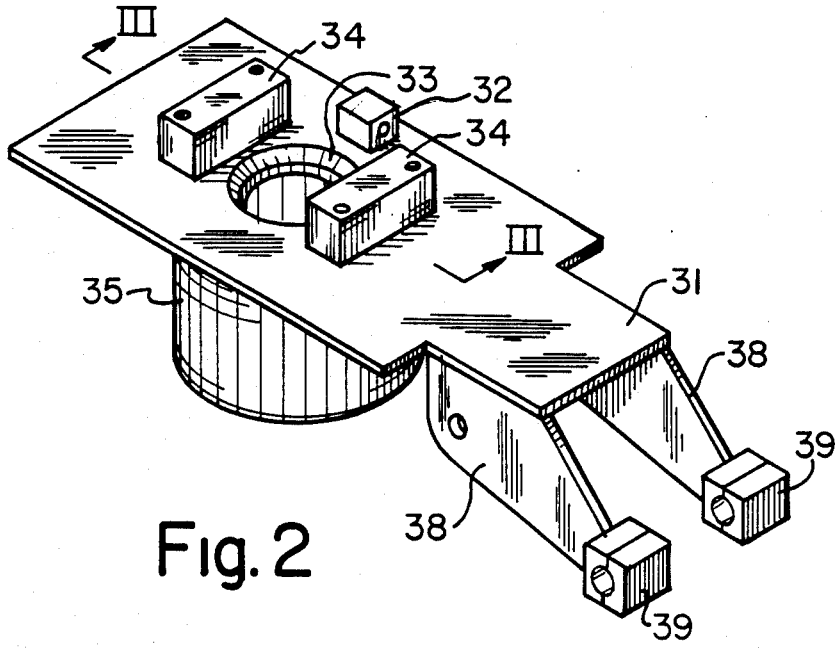
FIG. 2 is a perspective of the plenum box with attached brackets according to this invention.
Figure 3:
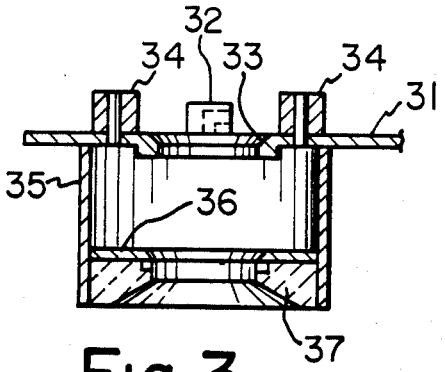
FIG. 3 is a broken away section taken along lines III—III of FIG. 2.

The details of the plenum box assembly 30 are best understood by reference to FIGS. 2 and 3. A main plate 31 has an opening therein through which the nozzle extension 24 passes. The main plate is shown elongate with the long axis thereof extending in the direction of slide gate motion. The opening has a conical interior edge 33 which is arranged to be adjacent a conical exterior edge of the nozzle (see FIG. 1). An asbestos or refractory fiber gasket may be placed along the conical interior edge 33 to provide a near gas tight seal between the main plate 31 and the nozzle extension 24. On top of the main plate are two spacer blocks 34 which may be permanently attached to the main plate having bores therein for aligning with bores in the main plate. Bolts (see FIG. 1) pass up through the main plate and the spacer blocks for securing the plenum box assembly to the bottom of the spring box carriage 22. The bolts are secured in threaded bores provided in the underside of the spring box carriage. The spacers are arranged near the opening in a way not to restrict the travel of the spring box carriage between its full open and full closed position. In other words, the bottom of the slide gate housing 20 has a rectangular opening therein with a width narrower than the width of the spring box carriage 22. The nozzle extension 24 and the spacer blocks 34 must move within the rectangular opening.

Pendant from the main plate 31 is the plenum box tube 35. The axial length of the tube is such that it extends downwardly just beyond the lower end of the nozzle extension (say, one to two inches). The diameter of the tube is not critical but may be about as great as the axial length thereof. Near the lower end of the tube 35 is positioned a diaphragm 36 having an opening therein for passage of the nozzle extension. A refractory lining 37 is provided on the underside of the diaphragm to protect it from sparks and splashes. In the specific embodiment illustrated, the lower surface of the refractory lining on the diaphragm is funnel shaped with the inner edge being adjacent the lower end of the nozzle extension. The width of the gap between the outer surface of the nozzle extension and the diaphragm is approximately $\frac{1}{4}$ to 1 inch. This is arranged to provide flow of inert gas out of the plenum along the teeming metal stream and into the hood assembly 40. The main plate, spacers, tube and diaphragm may be fabricated of carbon steel and joined by welding.

A bore in the top of the plenum box with an associated fitting 32 enables a source of inert gas to introduce inert gas to the interior of the tube.

Still referring to FIG. 2, brackets 38 are secured to main plate 31 and extend away from the tube 35. The brackets support bearing blocks 39 which are provided with shaft receiving bores.

Figure 4:
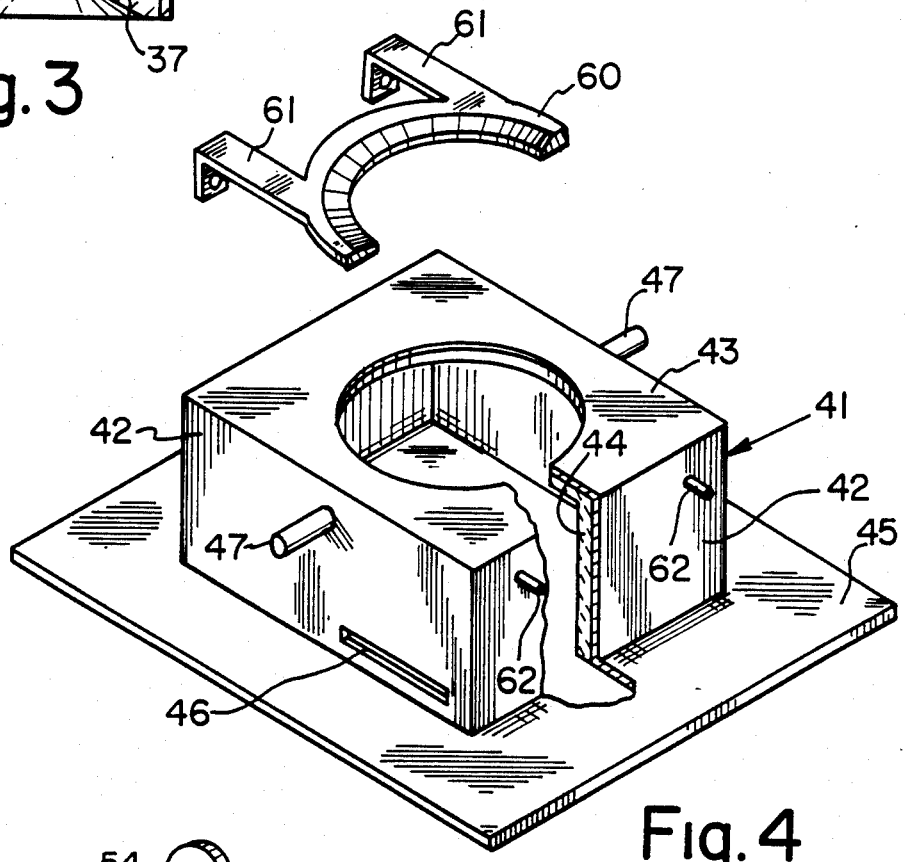
FIG. 4 is an exploded perspective of the hood assembly according to this invention.

Referring to FIG. 4, the hood assembly 40 comprises a rectangular or otherwise shaped hollow steel box 41 having downwardly extending sidewalls 42 and a cover 43. The cover has an opening therein having a diameter just greater (say, ⅜ to 1 inch) than the outer diameter of the tube 35. The sidewall and cover are provided with a refractory lining 44 to protect against sparks and splashes. The distance from the cover to the lower edges of the sidewalls is preferably just less than the length of the tube 35 permitting the lower edge of the hood to rise to or just above the lower end of the tube as will be explained. Preferably, the dimensions of the lower edges of the sidewalls are such that they may be positioned over the upper edges of an ingot mold or hot top. In this way, all of the heat radiating from the molten metal in the ingot mold is directed at a refractory lined surface. If the dimensions are much larger, the aligned hood would have nothing to rest its lower edges upon during teeming. If the dimensions are much less, the skirt flange 45 will be exposed to heat radiating up out of the ingot mold during teeming.

The skirt flange 45 extends horizontally outward from at least the two opposite walls which face in the directions of travel of the slide gate. As a practical matter, the skirt flange extends horizontally outward from each sidewall. Although the width of the skirt may be less, the width of the skirt flange is preferably at least as great as the stroke of the slide gate (usually about six to eight inches). The hood cover, sidewalls and skirt flange may all be fabricated from carbon steel and joined together by welding. All refractory linings described herein may be fired clay or high alumina type.

Figure 6:
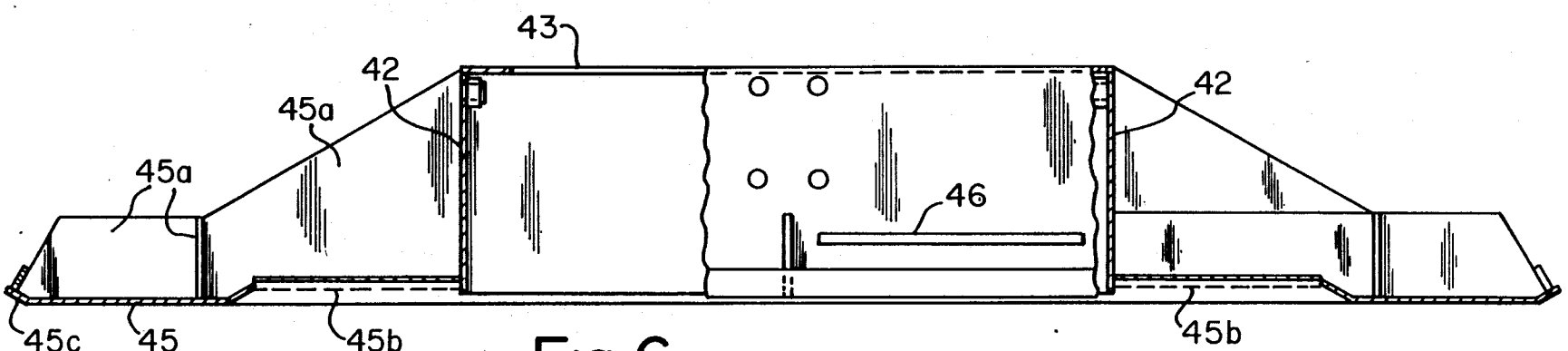
FIG. 6 is a broken away side view of a preferred hood with a partially insulated flange.

Referring to FIG. 6, a preferred hood is illustrated. (Note that the refractory lining within the hood is not shown.) The flange 45 is shown with several preferred features: A plurality of gussets 45*a* reinforce the flange against thermal warping. Also, the portion of the web that is exposed to heat radiating from hot metal during positioning of the hood is provided with heath insulation in the form of an expanded metal insert 45*b*. Insulation of the hood is required where the bottom opening of the hood is not as large as the top opening of the mold. Finally, the leading edges 45*c* of the flange are turned up so that it will easily ride over the edges of the ingot mold.

A very important feature of the hood is the provision of a narrow slot, say ½ inch wide, in one or more sidewalls. The slot 46 permits the visual observation of the teeming stream of hot metal.

Extending outwardly from the sides of the hood are trunnions 47 (FIG. 4). The common axis of the trunnions is generally horizontal and preferably, but not essentially, perpendicular to the direction of motion of the slide gate. Generally, the axis of the trunnions passes near or intersect the axis of the tube when the hood is mounted thereon. The hood is preferably symmetrically arranged about the axis of the trunnions to be more or less balanced for naturally hanging with its cover and skirt flange horizontal. The trunnions 47 are engaged by the distal ends of forks 51 of the actuating assembly 50 (yet to be described) and support the hood relative to the plenum box assembly. To avoid binding, the opening in the cover 43 is somewhat larger than the outer diameter of the tube 35. However, the annular slot remaining permits the escape of inert gases much more rapidly than may be acceptable. Thus, an apertured plate or ring 60 is arranged to slide over the top face of the cover 43 to impede flow upwardly out of the hood through the annular slot. The ring has an inner diameter very nearly the same as that of the tube, say within ⅛ inch. This clearance is just sufficient to enable the ring to slide up and down along the tube with a necessary amount of angular cocking allowed for. The ring 60 may simply rest upon the top face of the cover 43 or it may be slidably attached thereto, for example by brackets 61 and pins 62 as shown in FIG. 4. Many other arrangements for slidable attachment are possible. They must, however, permit the sliding in the direction perpendicular to the axis of the trunnions. As the forks 51 swing to raise or lower the hood relative to the plenum box, the arcuate motion of the trunnions will cause horizontal movement (perpendicular to the trunnions) between the hood and the plenum box assembly. The sliding of the ring 60 over the cover will accommodate this relative movement.

Figure 5:
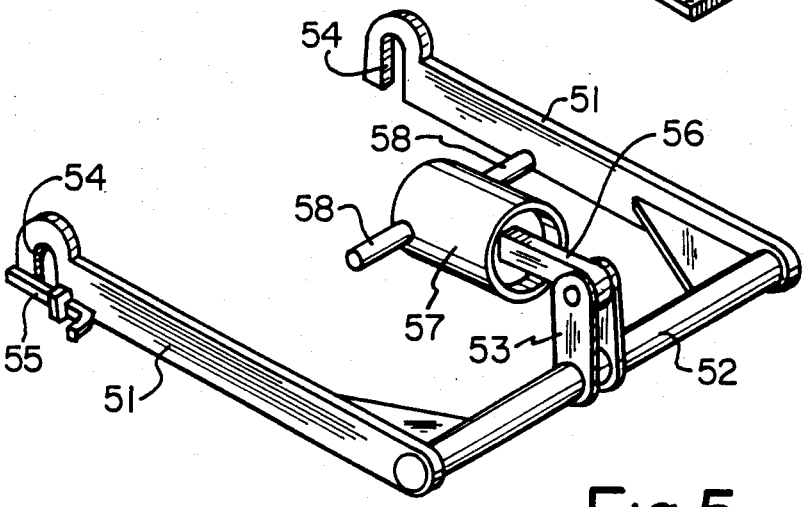
FIG. 5 is a perspective view of the actuating mechanism for raising and lowering the hood.

Referring now to FIG. 5, the actuating mechanism comprises shaft 52. The shaft, when journaled in bearing blocks 39, has a central portion between the bearing blocks and two end portions extending outwardly from the bearing blocks. A crank arm 53 is fixed to the center of the shaft to rotate therewith. When the entire apparatus is assembled, the crank arm is located between the bearing blocks. At the outer ends of the shaft, the forks 51 are fixed to rotate with the shaft. At the distal ends of the forks 51 are slots 54 opening downwardly for being placed over the trunnions 47 extending from the hood. A slide bolt 55 is arranged to capture the trunnions in the slot. Thus, it is possible to rapidly change hoods even when the ladle is filled with hot metal where, for example, one hood should fail or, for example, an ingot mold having a differently dimensioned top is encountered. Pivotally secured to the other end of the crank arm 53 is an expandable pneumatic device, for example, the piston 56 and cylinder 57. A single acting cylinder arranged so that pressurizing the ram raises the hood and venting the ram lets gravity lower the hood is satisfactory. The cylinder 57 has pins 58 extending laterally thereof which are journaled in the brackets 38. Thus,the piston and cylinder move in the space between the brackets.

Expansion of the cylinder causes rotation of the shaft 52 moving the slotted ends of the forks 51 upward. In this way, the hood can be telescoped over the tube in its up position. In this position, the bottom of the nozzle extension 24 is easily inspected and, if need be, it can be cleaned with an oxygen lance as is common practice. In its lowered position, the hood 40 may rest on the top edge of an ingot mold or a hot top even if the top edge is not completely horizontal. The slots in the ends of the forks and the trunnions enable restricted rotation of the hood around two perpendicular axes.

Operation

Prior to the start of teeming, the ingot molds may be purged with an inert gas and covered with a burn through cover such as a cardboard or foil sheet 70. Where the puged gas is heavier than air, it is only necessary that the covering prevent the easy intermixing of atmosphere with the gas in the mold. The ladle is then aligned with the ingot mold; that is, with the fixed aperture of the slide gate directly above the ingot mold opening. The hood is then lowered so that the skirt flange rests upon the top of the mold or the hot top as the case may be. Thereafter, the slide gate may be opened, dragging the hood over the top of the mold into alignment with the mold. The inert gas is introduced into the plenum box almost continuously and certainly for a period of time after the hood has been lowered and before the slide gate is opened. Thus, the teeming steel is completely surrounded by low pressure inert gas during the entire teeming of the ingot.

Having thus described the invention with the detail and particularity required by the Patent Laws, what is desired protected by Letters Patent is set forth in the following claims.

We claim:

1. An apparatus for providing a protective gas shroud around molten metal being teemed into an ingot mold from a ladle having a slide gate secured to the bottom thereof, comprising:

(a) a plenum box sealed to and extending downwardly from the sliding part of the slide gate;

(b) a hood telescopically extendable and retractable with respect to the plenum box and forming a rough sliding seal therewith, said hood having a skirt flange at the bottom thereof;

(c) means fixed relative to the plenum box to extend and retract the hood to accommodate varying distances between the ladle and the ingot mold; and (d) means for introducing a protective gas into the plenum box; whereby the ladle may be aligned with the mold into which hot metal is to be teemed and the means for raising and lowering the hood may be activated to lower the skirt flange to rest upon the top of the mold or hot top and thereafter the slide gate may be opened dragging the hood over the top of the mold or hot top into alighment with the mold.

2. The apparatus according to claim 1 wherein the width of the skirt flange in the direction of movement of the slide gate is equal to or greater than the maximum slide gate movement.

3. The apparatus according to claim 1 wherein the width of the skirt flange in the direction of movement of the slide gate is approximately equal to the maximum slide gate movement.

4. Apparatus according to claim 1 wherein the means for raising and lowering the hood provides a limited amount of relative angular motion about two axes.

5. Apparatus according to claim 1 wherein an elongate nozzle extends downwardly from the sliding part of the slide gate and the plenum box is a hollow cylindrical structure having a set for sealing to the nozzle at the upper end and walls extending downward beyond the bottom of the nozzle.

6. Apparatus according to claim 5 wherein the plenum box has a diaphragm at the lower end and an opening which together with the nozzle defines an annular gap through which protective gas is directed downwardly along and around a molten metal stream, if any, flowing out of said nozzle.

7. Apparatus according to claim 6 wherein the lower face of the diaphragm has a refractory lining.

8. Apparatus according to claim 1 wherein the hood has a bottom opening approximately the size of the top opening of the ingot mold or hot top over which it is placed.

9. Apparatus according to claim 8 wherein the skirt flange extends generally horizontally outward from the lower edge of the hood.

10. Apparatus according to claim 8 wherein the interior of the hood has a refractory lining.

11. Apparatus according to claim 1 wherein the hood is provided with at least one horizontal slot near the bottom thereof to permit viewing of the molten metal stream but sufficiently small to enable a positive pressure of protective gas to be maintained in the hood.

12. The apparatus according to claim 1 wherein the underside of the skirt flange is provided with heat insulation.

13. An apparatus for providing a protective gas shroud around molten metal being teemed into an ingot mold from a ladle or the like having secured to the bottom thereof a slide gate assembly, said slide gate assembly comprising a fixed apertured plate,a movable apertured plate, a main housing secured to the bottom of the ladle providing a slideway and a spring carriage secured in the slideway of the main housing and said spring box carriage carrying and biasing the movable apertured plate against the stationary apertured plate, piston means for moving the spring box carriage within the main housing to bring the apertures in said plates into and out of registry, the improvement comprising:

(a) an elongate nozzle extending downwardly from the movable apertured plate;

(b) a plenum box extending downwardly from and secured to the underside of the spring box carriage to be carried thereby, said plenum box having an opening in the top thereof to receive the downwardly extending nozzle and means to form a rough seal around the periphery of the nozzle where it extends through the top of the plenum box;

(c) a bracket fixed to the plenum box and extending away from it;

(d) a shaft secured for rotation relative to said bracket with lifting forks fastened thereto;

(e) a hood telescopically extendable and retractable with respect to the plenum box, said plenum box having trunnions fixed thereto extending therefrom for engaging distal ends of lifting forks, said hood having a flange skirt extending outward from the lower edge thereof;

(f) piston means extending from said bracket for causing rotation of the shaft thus extending and retracting the hood to accommodate varying distances between the ladle and the ingot mold; and (g) means to introduce a protective gas into the plenum box; whereby after the ladle is aligned with the mold into which hot metal is to be teemed, the piston may be permitted to lower the hood until the skirt flange rests upon the top edge of the mold or hot top and the slide gate can be opened dragging the hood over the top of the mold or hot top into alignment with the mold.

14. Apparatus according to claim 13 wherein the distal ends of the lifting forks have elongated slots for receiving the trunnions extending from the hood, said slots being generally vertical.

15. In an apparatus for providing a protective gas shroud around molten metal being teemed into an ingot mold from a ladle or the like having secured to the bottom thereof a slide gate assembly, said gate assembly comprising a fixed apertured plate, a movable apertured plate, a main housing secured to the bottom of the ladle providing a slideway and a spring box carriage secured in the slideway of the main housing and said spring box carriage carrying and biasing the movable apertured plate against the stationary apertured plate, piston means for moving the spring box carriage within the main housing to bring the apertures in said plates into and out of registry, the improvement comprising:

(a) an elongate nozzle extending downwardly from the movable apertured plate;

(b) a plenum box extending downwardly from and secured to the underside of the spring box carriage to be carried thereby, said plenum box having an opening in the top thereof to receive the downwardly extending nozzle and means to form a rough seal around the periphery of the nozzle where it extends through the top of the plenum box;

(c) a bracket fixed to the plenum box and extending away from it;

(d) a shaft secured for rotation relative to said bracket with lifting forks fastened thereto;

(e) a hood telescopically extendable and retractable with respect to the plenum box, said plenum box having trunnions fixed thereto extending therefrom for engaging distal ends of lifting forks, said hood having a flange skirt extending outward from the lower edge thereof;

(f) piston means extending from said bracket for causing rotation of the shaft thus extending and retracting the hood to accommodate varying distances between the ladle and the ingot mold; and (g) means to introduce a protective gas into the plenum box; whereby after the ladle is aligned with the mold into which hot metal is to be teemed, the piston may be permitted to lower the hood until the skirt flange rests upon the top edge of the mold or hot top and the slide gate can be opened dragging the hood over the top of the mold or hot top into alignment with the mold.

16. Apparatus according to claim 15 wherein said hood is comprised of a top face with a circular opening in said top face for receiving the plenum box and providing a gap between said circular opening and the outer cylindrical face of said plenum box and a ring positioned on the top face of said hood so that the inner edge of the ring is in sliding contact with the outer cylindrical face of the plenum box, said ring arranged to rest over the gap between the plenum box and the hood.

17. Apparatus according to claim 16 wherein the ring is supported for sliding movement adjacent the top face.

18. A method of teeming molten metal into ingot molds from a ladle havng a slide gate thereon comprising the steps for:

(1) providing an apparatus secured to the bottom of the slide gate having:

(a) a plenum box sealed to and extending downwardly from the sliding part of the slide gate;

(b) a hood telescopically extendable and retractable with respect to the plenum box and forming a rough sliding seal therewith, said hood having a skirt flange at the bottom thereof, the width of said skirt flange in the direction of movement of the slide gate being greater than the maximum slide gate movement;

(c) means fixed relative to the plenum box to extend and retract the hood to accommodate varying distances between the ladle and the ingot mold; and (d) means for introducing a protective gas in the plenum box;

(2) purging the ingot molds and covering with a burn away temporary cover;

(3) placing the ladle over the ingot molds and lowering the hood; and (4) opening the slide gate dragging the hood over the top of the ingot molds.

* * * * *

UNITED STATES PATENT AND TRADEMARK OFFICE

CERTIFICATE OF CORRECTION

PATENT NO. : 4,589,465

DATED : May 20, 1986

INVENTOR(S) : Charles C. Gerding and Harold L. Majors

It is certified that error appears in the above-identified patent and that said Letters Patent is hereby corrected as shown below:

Column 2, line 58, "downwardly" should be --outwardly--;

Column 4, line 4, "engates" should be --engages--;

Column 6, line 56, "puged" should be --purged--;

Column 7, line 28, "alighment" should be --alignment--;

Column 7, line 44, "set" should be --seat--;

Column 8, line 10, "spring carriage" should be --spring box carriage--;

Signed and Sealed this

*Ninth* Day of *September 1986*

[SEAL]

*Attest:*

DONALD J. QUIGG

*Attesting Officer*

*Commissioner of Patents and Trademarks*